United States Patent [19]

Friesenbichler

[11] 4,015,805

[45] Apr. 5, 1977

[54] RAILWAY SWITCH OR RAILWAY CROSSING

[76] Inventor: Eduard Friesenbichler, Hauptstr. 6,, A 8740 Zeltweg, Austria

[22] Filed: Jan. 2, 1976

[21] Appl. No.: 646,337

[30] Foreign Application Priority Data

Jan. 9, 1975 Austria ..... 114/75

[52] U.S. Cl. ..... 246/458; 246/427; 246/432

[51] Int. Cl.[2] ..... E01B 7/12

[58] Field of Search ..... 104/130; 246/415 R, 246/427, 432, 454, 457, 458, 465, 468

[56] References Cited

UNITED STATES PATENTS

| | | | |
|---|---|---|---|
| 346,229 | 7/1886 | Shannon | 246/457 |
| 511,784 | 1/1894 | Meeker | 246/457 |
| 1,605,716 | 11/1926 | Gilmour | 246/432 |
| 1,820,586 | 8/1931 | Ulrich | 246/458 |

*Primary Examiner*—Stephen G. Kunin
*Attorney, Agent, or Firm*—Cushman, Darby & Cushman

[57] ABSTRACT

Railway switch for transferring railway vehicles from a main track to a siding and, respectively, crossing of a siding with a main track, the switch or crossing comprising a frog in which the rail of the main track is uninterrupted, noting that the portion of the rail of the siding located between the rails of a main track is ending adjacent the rail of the main track to leave a gap for the wheel flanges of the wheels travelling on the main track, that the rolling surface of the rail portion of the siding located between the rails of the main track is, in the area adjacent the rail of the main track, superelevated relative to the rolling surface of the rail of the main track and that the portion of the rail of the siding located outside of the rails of the main track is provided with a ramp for ligting the wheel flanges, said ramp ascending until the height of the rolling surface of the main track, characterized in that the rolling surface of the portion of the rail of the siding located between the rails of the main track is located with its uppermost area at a greater height than the rolling surface of the rail of the main track for an amount corresponding at least to one half of the difference between the diameter of the wheel flange and the diameter of the rim of wheel subjected to maximally tolerable wear and is descending like a ramp in direction to the area adjacent the rail of the main track to a height which is greater for maximally one half of the difference between the diameter of the wheel flange and the rolling surface of the rim of a new wheel than the height of the rolling surface of the rail of the main track and is preferably approximately greater for one half of the difference.

7 Claims, 7 Drawing Figures

RAILWAY SWITCH OR RAILWAY CROSSING

In railway switches and railway crossings, frogs are provided, in which the rails are crossing one another. In railway switches and railway crossings of usual type, the rails are interrupted at the location of said frog, so that the train speed must be reduced when the train is travelling over such a switch or crossing. In those cases, in which a subordinate siding is branched off a main track or is, as with a track of works railway or other sidings, crossing such a main track being travelled upon in most cases with high speeds, such a reduction in speed is intolerable for railroad operation because the main tracks are in ever increasing extent reconstructed as high speed tracks for fulfilling the requirements of modern traffic, such as higher speeds with higher travelling comfort. In this case, railway switches are provided in which the wheels travelling on the siding are simply passed over the rail head of the main track so that any interruption of the running edge of rails within the main track is avoided and the main track can be travelled upon with full speed. The same possibility exists also with a main track being crossed by a siding, for example a track of works railway.

Now, the invention refers to a railway switch for transferring railway vehicles from a main track to a siding and, respectively, to a crossing of a siding with a main track, said switch or crossing comprising a frog in which the rail of the main track is uninterrupted, noting that the portion of the rail of the siding located between rails of the main track is ending adjacent the rail of the main track to leave a gap for the wheel flanges of the wheels travelling on the main track, that the rolling surface of the rail portion of the siding located between rails of the main track is, in the area adjacent the rail of the main track, arranged at a higher level or greater height relative to the rolling surface of the rail of the main track and that the portion of the rail of the siding located outside of rails of the main track is provided with a ramp for the mounting of the wheel flanges, said ramp ascending until the level or height of the rolling surface of the main track. In such railway switches or railway crossings, a wheel travelling on a rail of the siding is, on one side of the rail of the main track, rolling on a rolling surface of the rim of wheel and, on the other side of said rail of the main track, on the wheel flange. The difference between the diameter of the rolling surface of the rim of wheel and the diameter of the wheel flange of a considered wheel is, however, dependent on the degree of wear of the rim of wheel. The heavier said wear the greater the difference in diameters. For railroad traffic it is specified which differences in diameters of the rim of wheels is tolerable and this difference in diameters is generally approximately 20 mm for tracks of normal gauge. This means a tolerable difference in radii of about 10 mm between the rim of new wheels and the rim of wheels worn to the tolerable limit. With a frog designed for new wheels the step to be overcome by maximally worn wheels when travelling in the one or in the other direction amounts to about 10 mm. In view of the tolerances existing in new wheels, a shock-free transition over the frog of known railway switches of this type of construction is practically never possible. Such a shock results in an early wear of the rails and of the frog, in the danger of damaging the rolling surface of the rail of the main track and in the danger of damaging the rim of wheel and it is even possible that part of the wheel flange is broken out. If such a damaged area of wheel flange is not recognized in time and the respective car is still used, there is, in addition, the increased danger of derailment.

The invention now aims at avoiding the mentioned drawback and essentially consists in that the rolling surface of the portion of the rail of the siding located between the rails of the main track is located with its uppermost area at a higher level or greater height than the rolling surface of the rail of the main track for an amount corresponding at least to one half of the difference between the diameter of the wheel flange and the diameter of the rim of wheel subjected to maximally tolerable wear and is descending like a ramp in direction to the area adjacent the rail of main track to a height or level which is greater or higher, respectively, for maximally one half of the difference between the diameter of the wheel flange and the diameter of the rolling surface of the rim of a new wheel than the height or level, respectively, of the rolling surface of the rail of the main track and is preferably approximately greater or higher, respectively, for one half of said difference. In this manner, full adaptation is achieved for the rim of new wheels as well as for maximally worn rims of wheel. The wheel travelling on the frog and having its rim rolling on the ramp is being gradually lowered by means of the ramp and, depending on the rim of wheel being new or more or less worn, the rim of wheel will later or earlier reach the rolling surface of the rail of the main track, so that in any rate, independent from the degree of wear of the rim of the wheel, a shock-free transition will result and excessive wear and injury of individual constructional parts is made impossible.

According to the invention, the arrangement is conveniently such that the ramp descending from the uppermost portion of the rolling surface of the rail of the siding to the rail of the main track has an inclination in transverse direction which approximately corresponds to the taper of the rolling surface of a non-worn rim of wheel. The rolling surface of the rim of wheel is primarily worn adjacent the wheel flange whereas the marginal portions more distant from the wheel flange are the least subjected to wear. In view of the inclination of the ramp in transverse direction, the wheel is running on said lesser worn marginal portions, so that the difference between travelling wheels with non-worn rolling surface and travelling wheels with worn rolling surface will become smaller.

According to the invention, the arrangement can be such that the ramp has, at the side facing the wheel flange, a zone without inclination in transverse direction, said zone, starting from the uppermost portion, becoming increasingly narrower and adjoining the ramp surface having an inclination in transverse direction corresponding to the taper of the rim of the wheel along an edge of intersection extending in longitudinal direction of the rail. With such a construction, the wheel is running on the ramp along said edge of intersection so that rolling of the wheel becomes more uniform.

The invention provides a shock-free travelling on the siding at the area of the frog in both directions because shocks caused by a sudden lifting of a wheel and otherwise responsible for wear can be avoided. With new, non-worn rims of wheel any shock is avoided if the height onto which the running surface of the siding is descending is located above the running surface of the rail of the main track for maximally one half of the difference in diameters between the rolling surface of the rim of wheel and the wheel flange of the non-worn rim of wheel, because in this case the wheel flange is softly engaging the ramp surface. This height or super-elevation over the rolling surface of the rail of the main track ought not be substantially smaller, because the difference of the diameters between the rolling surface of the rim of wheel and of the wheel flange is, with non-worn rim of wheel, at any rate the smallest difference in diameters to be considered. When making this height smaller, the ramp would become unnecessarily long and it is just for this reason that it is of advantage to locate the height or level onto which the rolling surface of the siding is descending approximately for one half of the difference in diameters of the wheel flange and of the rolling surface of the non-worn rim of wheel above the height or level of the rolling surface of the rail of the main track. By this arrangement it is, in most cases, made possible that the wheel rolling on the siding is engaging with its rolling surface the descending rolling surface of the rail of the siding until it has passed over the groove provided for the wheel flange of the wheel rolling on a rail of the main track, so that the wheel flange of the wheel travelling on the siding does not contact the rolling surface of the rail of the main track.

The construction according to the invention has as a result that a wheel travelling on a frog is being lifted what has as a consequence that the railway car assumes an oblique position. For at least partially compensating this effect, the rolling surface of the second rail of the siding can, according to the invention, equally be at a higher level in those cross sections of the siding in which the rolling surface of the rail of the siding intersecting the frog is equally at a higher level. The term "cross section of the siding" is to mean a section through those portions of the siding which are simultaneously travelled upon by wheels arranged on the same axis. It is possible to arrange the second rail of the siding at the same level as the first rail, however, it is not necessary to completely compensate the level difference. It is only essential to reduce an inclination of the wheel axes and, respectively, of the railway car and thus also to reduce the danger or derailment when travelling on the siding. Furthermore it is possible to provide guide rails for the second rail of the siding which maintain the wheels arranged on a common wheel axis within the track gauge. It is further advantageous to provide these guide rails in form of inner guide rails and outer guide rails which extend over the height of the rolling surface of the second rail. This provides full security because such guide rails arranged on both sides secure the wheel independent from the wheel flange engaging the rail or not. Such guide rails keep within the track the wheel travelling on the frog via the siding in spite of the greater super-elevation of the ramp even if the second rail is not super-elevated. It is, however, of advantage to super-elevate or to arrange at a higher level the rolling surface of the second rail as well as to provide guide rails.

The invention is schematically illustrated with reference to a non-restrictive embodiment.

Figure 6:
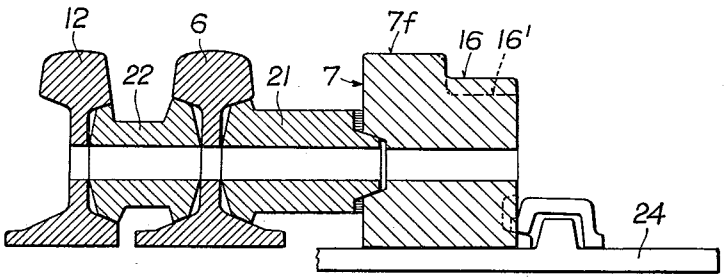
Figure 5:
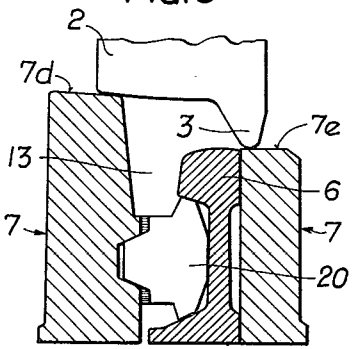
Figure 4:
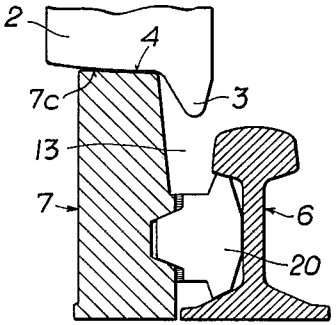

FIG. 4, FIG. 5 and FIG. 6 respectively show a cross section along line IV—IV line V—V and line VI—VI in a still larger scale.

Figure 7:
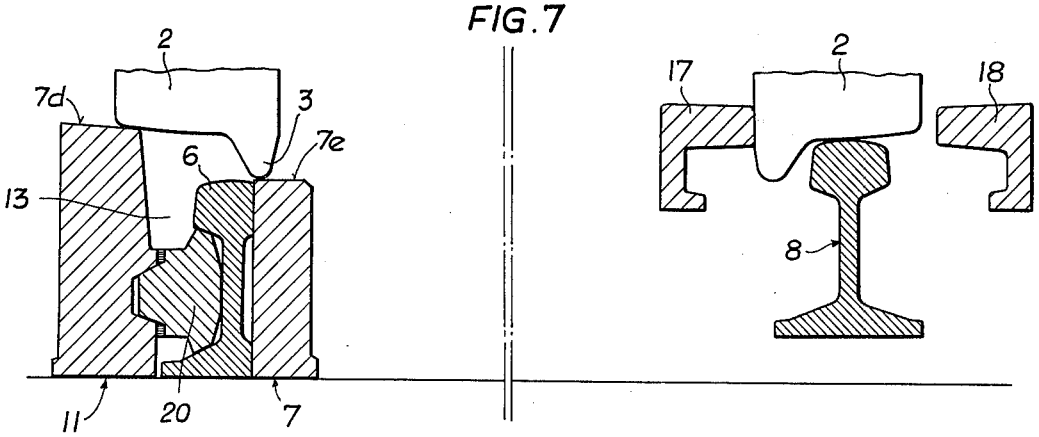
Figure 3:
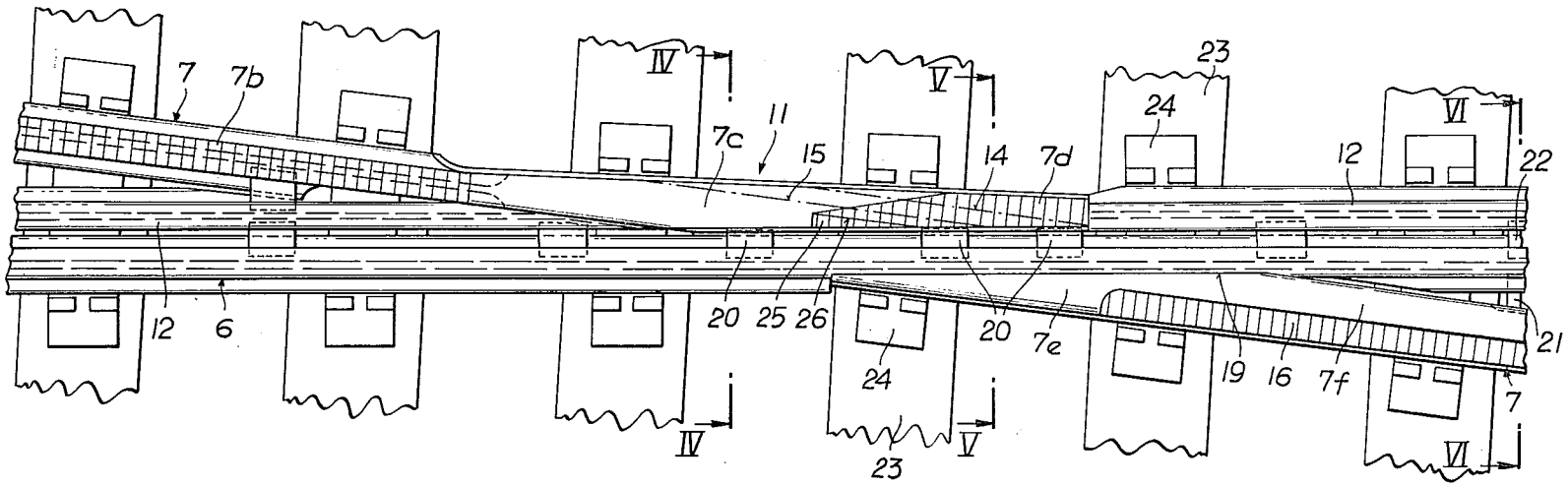
FIG. 3 represents in an enlarged scale the area of the frog.

FIG. 7 shows a section through the siding at the location of section V—V of FIG. 3.

Figure 1:
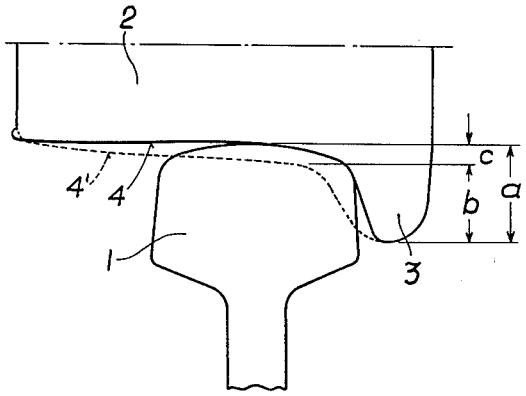
FIG. 1 illustrates the varying degree of wear of a rim of wheel.

In FIG. 1 there is shown a rail head 1 in contact with a wheel having a rim 2 and a flange 3. The rolling surface of the wheel as worn to the maximally tolerated extent is designated 4. Dashed line 4' is illustrating the new, non-worn rolling surface of the wheel. One half of the difference in diameters between the rolling surface 4 and, respectively, 4' of the wheel and of the wheel flange 3 thus assumes the value *a* for a worn rim of wheel and the value *b* for a new, non-worn rim of wheel. The difference between these two values is designated *c* and this value *c* is approximately 10 mm.

Figure 2:
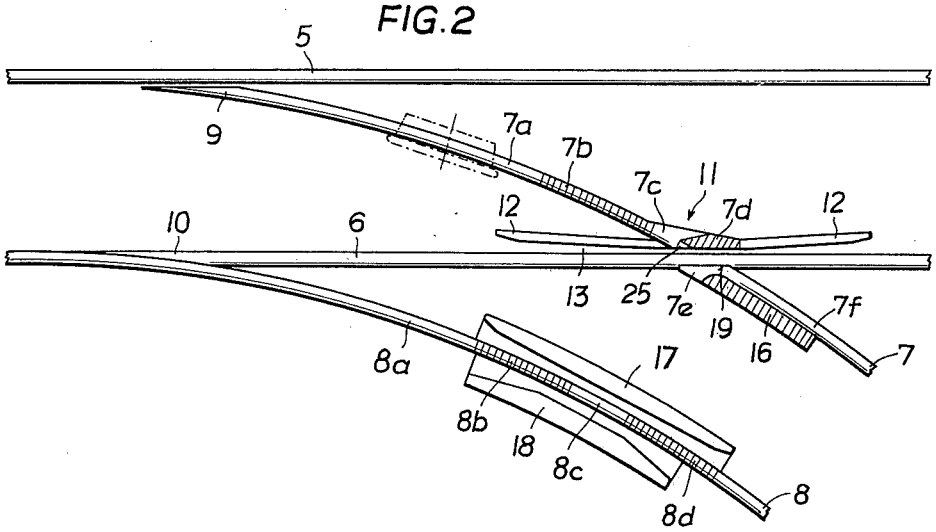
FIG. 2 represents a top-plan view of a railway switch, noting that the radius of curvature of the siding, for example a track of works railway, is, for the purpose of clarity, shown to be relatively small.

In FIG. 2, the two rails of the main track are designated 5 and 6. The two rails of the siding are designated 7 and 8. 9 is a tongue of the rail 7 of the siding which is disengaged from rail 5. 10 is a tongue of the main track engaging rail 8 of the siding. This straight tongue can be travelled upon with full speed. 11 is the frog within which the rail 6 of the main track is passing through without interruption. 12 is a guide rail which limits the wheel flange groove 13. The radius of curvature of rails 7 and 8 is, for the purpose of greater clearness, shown relatively small in FIG. 2. The construction of the frog 11 follows from FIG. 3 which shows the rails 7 and 8 with their correct radius of curvature.

Within the area 7*a*, the rolling surface of the rail 7 of the siding is located at the level or height of the rolling surfaces of the rails 5 and 6 of the main track. Within the area 7*b*, the rolling surface is ascending like a ramp and reaches its greatest height or highest level at the area 7*c* within which the rolling surface is horizontally arranged and within which the height is greater for the value *a* (FIG. 1) than the height of the rolling surface of the rail 6 of the main track. In continuation of the area 7*c*, there is an area 7*d* within which the rolling surface is descending to a height which is approximately greater for the value *b* than the height of the rolling surface of rail 6 of the main track. Outside of the main track, rail 6 of the main track is engaged by an area 7*e* of rail 7 of the siding in which the rolling surface of rail 7 has the same height or is at the same level as is the rolling surface of rail 6 of the main track. This area 7*e* has again as a continuation an area 7*f* in which the rolling surface of rail 7 of the siding has the same height or is at the same level as is the rolling surface of the rail 6 of the main track.

The wheel rolling on the rail 7 of the siding, thus travels with its rolling surface over the ramp provided at the area 7*b* and over the horizontal area 7*c*. This position is shown in a cross section in FIG. 4. Behind the area 7*c*, the rolling surface of the wheel travels on ramp 7*d* until the wheel flange of the wheel is engaging the flat area 7*e* of the surface of rail 7. The wheel has a certain play in axial direction of the rail. 14 represents the outermost track of the wheel and 15 is the innermost track of the wheel. Thus, it is obvious, that the wheel is travelling on its rim of wheel until the wheel flange is engaging the flat area 7*e* of rail 7 approximately within cross section V—V. This position is shown in a cross section in FIG. 5. In FIGS. 4 and 5 the shape of a maximally worn rim of wheel is shown with its rolling surface 4 as illustrated by FIG. 1. With a non-worn rim of wheel or with a rim of wheel worn to a lesser extent, the rolling surface of the wheel is remaining on ramp 7*d* for a longer period, so that the wheel flange will exert its supporting action at a location located nearer to area 7*e*. By providing the guide rail 12 it is possible to keep small the wheel flange groove 13 and to arrange ramp 7*d* as close as possible to rail 6 of the main track.

Within area 7*d*, the rolling surface of rail 7 of the siding is given the shape of a ramp descending in longitudinal direction of this rail and simultaneously having, as is shown in FIG. 5, an inclination in transverse direction corresponding to the taper of the rolling surface 4' of a non-worn rim of wheel. In view of the rim of wheel being subjected to the most severe wear adjacent the wheel flange 3, the marginal portion of the rolling surface most remote from the wheel flange is mainly made use of for exerting the supporting action as can be also derived from FIG. 4 showing a wheel having a worn rolling surface 4. The worn wheel is thus rolling within the area delimited by lines 14 and 15 showing the outermost track of wheel. Thus, any differences resulting from a worn rim of wheel and a non-worn rim of wheel are reduced. 25 represents a surface without transverse inclination and adjoining the ramp along a line of intersection 26.

Starting from the area 7*e* of rail 7 of the siding, the wheel flange arrives at a descending ramp 16. The wheel travels, with its rolling surface disengaged from rail 7 within area 7*f* (see FIG. 6), with its wheel flange on ramp 16 until its rolling surface is engaging the rolling surface of rail 7. In the last-mentioned position the height or level of ramp 16 is designated 16' in FIG. 6.

Within the area 7*a* and within the area adjoining the area 7*f* rail 7 is a Vignoles' rail of usual type. Within the area 7*b*, 7*c*, 7*d*, 7*e* and 7*f*, rail 7 consists of correspondingly shaped blocks. Within the area 7*e* the head of rail 6 has a recess at 19 and the contacting rail 7 is interlocked with this recess. The relative position of rails 6 and 7 and the guide rail 12 is secured by line plates 20, 21 and 22. The rails are fixed to the sleepers 23 by means of correspondingly shaped ribbed plates 24.

The rolling surface of the second rail 8 is horizontally arranged within area 8*a* and located in the plane of the rolling surfaces of rails 5 and 6 of the main track, whereas said rolling surface of rail 8 is ascending within area 8*b*. Within area 8*c* the rolling surface is again horizontally arranged, whereas this rolling surface is descending like a ramp within area 8*d*. In this manner, inclination of the axis and, respectively, railway car is reduced. Within the areas 8*b*, 8*c* and 8*d* two guide rails, i.e., an inner guide rail 17 and an outer guide rail 18, are provided for securing a correct movement of the wheels coupled to the same axis when travelling over the frog 11. As is shown in FIG. 7, guide rails 17 and 18 are at a higher level than the rolling surface of rail 8 and thus located on either side of the rim 2 of wheel.

What I claim:

1. A railway switch for transferring railway vehicles from a main track to a siding and, respectively, crossing of a siding with a main track, said switch or crossing comprising a frog in which one rail of the main track is uninterrupted, noting that a portion of a rail of the siding located between the rails of a main track ends adjacent said one rail of the main track leaving a gap for wheel flanges of wheels travelling on the main track, that a rolling surface of the rail portion of the siding located between the rails of the main track is, in the area adjacent said rail of the main track, super-elevated relative to a rolling surface of said rail of the main track and that a portion of the rail of the siding located outside of the rails of the main track is provided with a ramp for lifting the wheel flanges, said ramp ascending to the height of the rolling surface of the main track, characterized in that the rolling surface of the portion of the rail of the siding located between the rails of the main track is located with its uppermost area at a greater height than the rolling surface of said rail of the main track for an amount corresponding at least to one half of the difference between the diameter of the wheel flange and the diameter of the rim of a wheel subjected to maximally tolerable wear and descends like a ramp to an area adjacent said rail of the main track to a height which is greater for maximally one half of the difference between the diameter of the wheel flange and the rolling surface of the rim of a new wheel than the height of the rolling surface of said rail of the main track and is preferably approximately greater for one half of said difference.

2. A railway switch or crossing as claimed in claim 1, characterized in that said ramp descending from the uppermost area of the rolling surface of the rail of the siding to said rail of the main track has an inclination in a transverse direction approximately corresponding to the taper of the rolling surface of the non-worn rim of a wheel.

3. A railway switch or crossing as claimed in claim 2, characterized in that said ramp descending from said uppermost area has, at the side facing the wheel flange, a zone without transverse inclination, said zone becoming increasingly narrower starting from the uppermost area and adjoining the surface of said descending ramp, having a transverse inclination corresponding to the taper of the rolling surface of the wheel, along an edge of intersection extending in a longitudinal direction of the rail.

4. A railway switch or crossing as claimed in claim 1, characterized in that at the area of the frog a guide rail is arranged beside said rail of the main track.

5. A railway switch or crossing as claimed in claim 1, characterized in that the rolling surface of the rail of the siding located outside of the rails of the main track is equally super-elevated in those cross sections of the siding in which the rolling surface of the rail of the siding passing through the frog is super-elevated.

6. A railway switch or crossing as claimed in claim 1, characterized in that beside the rail of the siding located outside the rails of the main track, guide rails are provided along those cross sections of the siding in which the rolling surface of the rail of the siding passing through the frog is super-elevated.

7. A railway switch or crossing as claimed in claim 6, characterized in that the guide rails are formed of inner guide rails and outer guide rails which extend above the height of the uppermost area of the rolling surface of the rail of the siding located outside the rails of the main track.

* * * * *